US005944956A

United States Patent [19]

Marcheggiani

[11] Patent Number: 5,944,956

[45] Date of Patent: Aug. 31, 1999

[54] SURFACE-CLEANING DOCTOR FOR USE IN A PAPERMAKING OPERATION AND ASSOCIATED METHOD

[75] Inventor: Marco Marcheggiani, Knoxville, Tenn.

[73] Assignee: Valmet, Inc., Charlotte, N.C.

[21] Appl. No.: 08/840,997

[22] Filed: Apr. 22, 1997

[51] Int. Cl.[6] ..... A47L 5/14; D21F 7/00

[52] U.S. Cl. ..... 162/199; 162/275; 162/276; 162/279; 162/DIG. 7; 15/345; 15/346

[58] Field of Search ..... 162/193, 199, 162/360.2, 274, 275, 276, 277, 278, 279, 363, DIG. 7; 15/345, 346; 34/114, 120; 226/97.3; 134/122

[56] References Cited

U.S. PATENT DOCUMENTS

| | | | |
|---|---|---|---|
| 3,013,938 | 12/1961 | Justus et al. | 162/199 |
| 3,078,496 | 2/1963 | Doran et al. | 15/346 |
| 3,198,694 | 8/1965 | Justus | 162/360.2 |
| 4,556,453 | 12/1985 | Meinecke | 162/274 |
| 4,904,344 | 2/1990 | Peiffer . | |
| 5,232,555 | 8/1993 | Daunais et al. . | |
| 5,519,945 | 5/1996 | Ahvenniemi et al. | 34/122 |
| 5,603,775 | 2/1997 | Sjöberg | 134/21 |

FOREIGN PATENT DOCUMENTS 908747 10/1962 United Kingdom .

*Primary Examiner*—Jose' Fortuna
*Attorney, Agent, or Firm*—Michael E. McKee

[57] ABSTRACT

A doctor system (20) and an associated method for cleaning the moving surface (30) of a papermachine component (22) which is begrimed or wetted by a paper web (28) moved around the surface utilizes an air nozzle (54) supportable in a stationary condition adjacent the surface of the papermachine component for directing a stream of air in the form of a knife from a source generally toward the surface to dislodge grime and water from the surface. The system also includes a collection receptacle (68) positionable adjacent the nozzle for collecting grime and water which are dislodged from the surface by the air knife for disposal.

15 Claims, 3 Drawing Sheets

SURFACE-CLEANING DOCTOR FOR USE IN A PAPERMAKING OPERATION AND ASSOCIATED METHOD

BACKGROUND OF THE INVENTION

This invention relates generally to papermachines through which a paper web is routed and relates, more particularly, to means and methods for cleaning the surface of a papermachine component begrimed with pitch or other contaminates collected from a paper web as the web moves around the surface of the component. Examples of such components include the cylindrical rolls located in the pickup section of a papermachine as well as the synthetic belts and fabrics which engage the paper web in the press section of a papermachine.

Heretofore, the grimy, wet surface of a cylindrical roll of a papermachine has been mechanically cleaned with a doctor blade which is supported adjacent the surface of the roll. To this end, doctor blades of the prior art commonly include a hard (commonly steel) wiper tip which is maintained in contact with the surface of a roll so that as the roll is rotated about its axis, the doctor blade wipes water droplets and other contaminants (such as pitch or cellulosic fibers) from the surface of the roll. An example of a doctor blade of the aforedescribed class is shown and described in Great Britain Patent No. 908,747.

It is known that doctor blades of the aforedescribed class require frequent and costly servicing or replacement due to tip wear and are limited in their capacity to wipe water droplets from a perforated surface, such as the surface of a pick-up roll which employs a vacuum-enhanced section. If, for example, particles of grime or water droplets become lodged within the perforations of such a surface, the movement of the surface in contact with the tip of a doctor blade does not normally dislodge these droplets, and of course, if not removed from the perforations (by either the doctor blade or by the vacuum of the vacuum-enhanced section), these droplets can adversely affect the performance of the vacuum-enhanced section.

It is an object of the present invention to provide a new and improved means for cleaning a papermachine component whose surface has become grimy and wet from a paper web as the paper web moves around the surface of the component and an associated method.

Another object of the present invention is to provide such a means which removes grime and water from the surface of a papermachine component without mechanically contacting the surface of the component with a wiper tip thereby obviating any need for servicing or replacement of worn parts and circumventing the costs associated with such servicing or replacement of parts.

Still another object of the present invention is to provide such a means which is well-suited for dislodging particles of grime and water droplets from the perforations of a perforated surface of a papermachine component.

Yet another object of the present invention is to provide such a means which is uncomplicated in construction yet effective in operation.

SUMMARY OF THE INVENTION

This invention resides in a doctor system for cleaning the moving surface of a papermachine component which is begrimed or wetted from a paper web moved around the surface and an associated method.

The system of the invention includes a nozzle device supportable adjacent the moving surface of a papermachine component which is begrimed or wetted by a paper web moved around the surface for directing air from a source in such a relation to the surface to separate grime and water from the surface and thereby clean the surface. Also included within the system is a receptacle, or a collector, positionable adjacent the nozzle device for collecting grime and water which are separated from the surface by the directed air.

The method of the invention includes the steps involved in utilizing the system of the invention. In particular, the nozzle device is provided and then positioned in a stationary condition adjacent the surface of the papermachine component. Air is then directed through the nozzle device in a high speed stream from a source generally toward the moving surface to separate grime and water from the surface. The grime and water which are separated from the surface by the directed air is subsequently collected for disposal.

DETAILED DESCRIPTION OF THE ILLUSTRATED EMBODIMENTS

Figure 1:
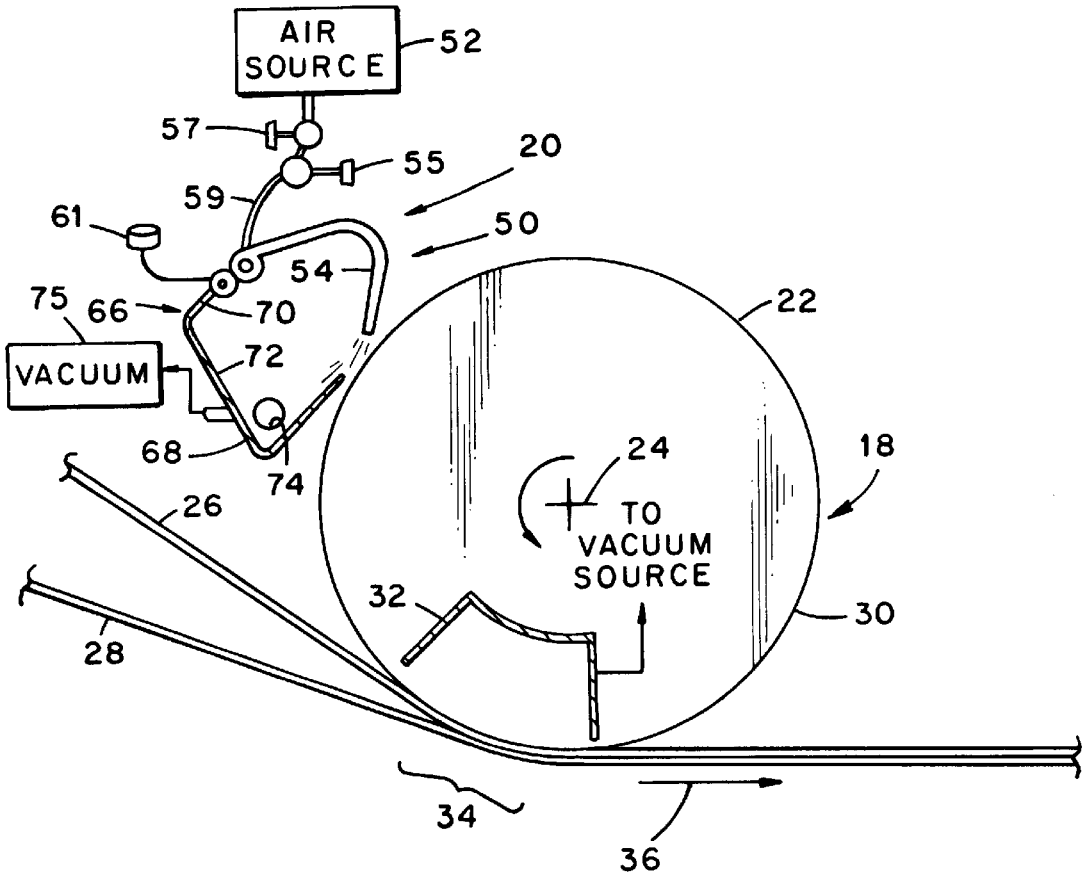
FIG. 1 is a schematic side view of a fragment of a cylindrical roll of a pick-up section of a papermachine within which an embodiment of a doctor system is utilized.

Turning now to the drawings in greater detail, there is shown in FIG. 1 an environment within which an embodiment, generally indicated 20, of a doctor system is utilized. More specifically, the depicted environment includes a pick-up section of a papermachine 18 having a cylindrical pick-up roll 22 mounted for rotation about an axis 24 (e.g. for counter-clockwise rotation about the axis 24 as viewed in FIG. 1) and further includes a carrier fabric 26 and a running web 28 which are moved into engagement with one another and around a sector, indicated 34, of the roll 22 in the direction of the arrow 36 during the rotation of the roll 22.

The depicted pick-up roll 22 has a peripheral surface 30 comprised of perforated stainless steel (which may be covered with a synthetic material) and employs a vacuum system having a compartment 32 supported beneath the surface 30 of the roll 22 for creating a vacuum zone along the sector 34 around which the web/carrier fabric arrangement is moved. During operation of the vacuum system 32, a region of low pressure (i.e. sub-atmospheric pressure) is created within the compartment 32 and along the sector 34 so that the web/carrier fabric arrangement is exposed to this created region of low pressure through the perforations provided within the surface 30. The exposure of web/carrier fabric arrangement to this created region of low pressure helps to transfer the web 28 and fabric 26 to the surface of the roll 22 for movement therearound.

It will be understood that as the paper web 28 is moved through the pick-up section of the papermachine 18, the paper web is likely to contain pitch, fragments of cellulosic fibers or other contaminants, and the content of water within the web 28 is normally relatively high (e.g. greater than about sixty percent water by weight). Consequently, as the web/carrier fabric arrangement is moved around the surface 30 of the roll 22, these contaminants are likely to be transferred from the web 28 to the roll surface where they collect as particles of grime until removed. Similarly, the water in the form of droplets are transferred from the web 28 to the roll surface 30 where the droplets are likely to cling until removed. Of course, if the particles of grime and the droplets of water are not removed from the surface 30 before the roll makes a complete revolution following the movement of the web 28 from the surface 30, the grime and water will again come into contact with the web 28 where they will either adversely affect the quality of the web 28, when ultimately dried, or hinder the drying of the web 28.

Figure 2:
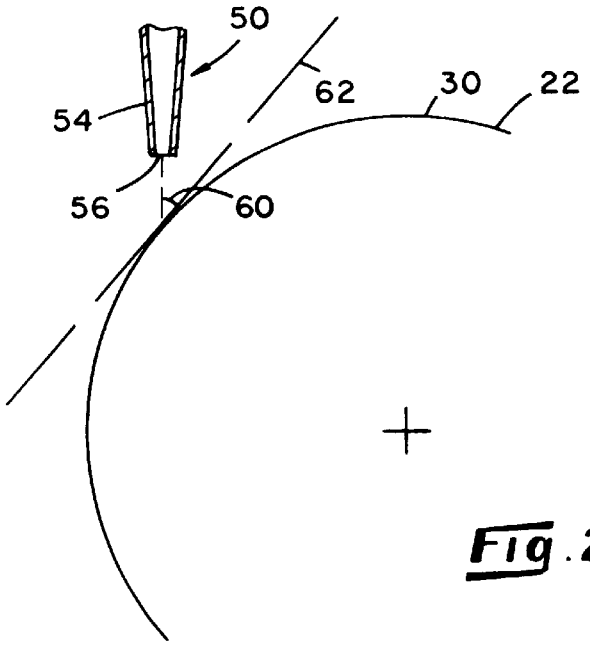
FIG. 2 is a view similar to that of FIG. 1 of a portion of the FIG. 1 fragment, but drawn to a slightly larger scale.

As will be apparent herein, the doctor system 20 cleans the surface 30 of grime and water before the grime and water are permitted to return into contact with the web 28 and carrier fabric 26. To this end, the system 20 includes means, generally indicated 50, for directing air from a source 52 (such as from a compressor or industrial fan) generally toward the roll surface 30. In the depicted system 20 and as best shown in FIG. 2, the air-directing means 50 includes an air nozzle 54 positionable in a stationary condition adjacent the roll surface 30 and having a discharge opening 56 which is directed substantially angularly with respect to the roll surface 30. More specifically, the nozzle 54 includes a tip comprised of a pair of steel sheets which converge toward one another as a path is traced therealong toward the discharge opening 56 so that the discharge opening 56 is in the form of a slot (of between about 1 mm and 3 mm in width) which extends substantially the entire length of the roll 22. Consequently, air which exits the discharge opening 56 exits the opening in a stream which is relatively narrow in width, yet relatively long in length so as to resemble a knife or, more specifically, the blade of a knife. In practice, this stream of air which exits the discharge opening 56 acts as a knife to separate the grime and water from the roll surface 30. Accordingly, the term "air knife" as used herein refers to the long and slender form of the air stream which exits the nozzle 54 as well as the severing action of the air stream which separates the grime and water from the roll surface 30.

It is a feature of the air-directing means 50 that it dislodges grime and water which cling to the surface 30 of the roll 22 as the roll surface 30 moves past the discharge opening 56. To this end, the nozzle 54 of the depicted system 20 is mounted adjacent the roll surface 30 so that its discharge opening 56 opens at an angle 60 with respect to an imaginary line 62 drawn tangent to the roll surface 30. The angle 60 could fall within the broad range of between zero and 180° so that the air knife which exits the nozzle 54 separates grime and water from the roll surface 30. It is believed, however, that for a given application, the value of the angle 60 can be determined for optimum system performance through trial and error techniques.

As far as the velocity of the air stream is concerned, the velocity of the air which exits the discharge opening 56 should be great enough to separate tacky particles of grime (such as pitch) from the roll surface. To this end, the velocity of the air stream which exits the opening 56 is appreciably greater than that of the surface 30 as it moves past the opening 56, and is preferably at least about one and one-half times greater than the speed of the roll surface 30. Depending upon the degree of roll cleanliness desired to be achieved with the system 20, the velocity of the air stream exiting the nozzle 54 can fall between 8,000 and 40,000 feet per minute, and any speed within this range is attainable with known technology.

In order to permit the control of pressure within and flow of air through the nozzle 54 and with reference again to FIG. 1, there are appropriate pressure and flow control valves 55 and 57, respectively, mounted within the conduit 59 joined between the nozzle 54 and the air source 52. Furthermore, a closeable access port 61 is mounted upstream of the nozzle 54 and in flow communication with the conduit 59 which permits the introduction of a cleaning substance, such water or a mixture of water and sodium bicarbonate, into the air stream moving toward the nozzle 54. By occasionally introducing such a substance into the air stream, the introduced substance exits the nozzle 54 and strikes the roll surface 30 at a high velocity with the air knife to help condition or treat the roll surface 30.

The doctor system 20 also includes receptacle means (or collector means), generally indicated 66, for collecting grime and water which are dislodged from the surface of the roll 22 for disposal. To this end, the receptacle means 66 includes an open, trough-shaped receptacle 68 which is positioned in such a relation to the roll 22 so as to open generally toward a location on the roll surface 30 situated downstream of the nozzle 54 for collecting the particles of grime and water droplets which are separated from the roll surface 30 by the air knife which exits the nozzle 54. To this end, the receptacle 68 is provided by top and bottom walls 70 and 72, respectively, and a drain 74 is provided adjacent the bottom wall 72 of the receptacle 68 for accommodating the evacuation and disposal of grime and water which have been collected within the receptacle 68. If desired, a vacuum source 75 can be connected to the drain 74 to actively evacuate the interior of the receptacle 68 during operation of the system 20 and provide an exhaust through which air (directed out of the nozzle 54) is permitted to escape from the receptacle 68.

As the high-velocity air is forced out of the discharge opening 56 of the nozzle 54 in the form of an air knife, the air strikes the surface 30 of the roll 22 in a manner which wipes the roll surface 30 clean by separating grime and water from the surface 30. Furthermore, any particles of grime or water droplets which may become trapped within the perforations of the surface 30 are blown free of the perforations by the air knife so that the communication between the vacuum compartment and the web/fabric arrangement through the perforations is not hindered as the surface 30 moves through the (vacuum-enhanced) sector 34.

The particles of grime and water droplets which are separated from the roll surface 30 are prevented from returning to the roll surface 30 by the bottom wall 72 of the receptacle 68 and, instead migrate (e.g. gravitationally) toward the bottom of the receptacle 68 for evacuation through the drain 74. When a vacuum source 75 is employed to evacuate the interior of the receptacle 68 through the drain 74, the grime and water are removed from the receptacle interior at an increased speed.

It follows that the doctor system 20 cleans the roll surface 30 with an air knife as the surface of the roll 22 moves past the nozzle discharge opening 56 so that by the time that the roll surface 30 moves past the receptacle 68 of the system 20, the surface 30 is free of grime and is relatively dry. Therefore, when the surface 30 is again moved into engagement with the web/fabric arrangement, the surface 30 is devoid of substances which could hinder the drying of the web 28 or adversely affect the quality of the web 28, when ultimately dried. It also follows that the doctor system 20 employs no components which contact and are therefore likely to wear against the roll surface 30. Therefore, unlike the doctor blades of the prior art which require occasional servicing or replacement for tip wear (and costs associated therewith) and are responsible for wear of the roll surface, the doctor system 20 requires no servicing for wear and does not wear the roll surface 30. Accordingly, the doctor system 20 is believed to require less overall maintenance and be less expensive than doctor blades of the prior art, and the doctor system 20 is advantageous in this respect.

Although the aforedescribed embodiment has been shown and described for cleaning grime and water from the surface 30 of a pick-up roll 22 located within the pick-up section of a papermachine 18, the doctor system can be advantageously used to clean other surfaces of papermachine components which are likely to become grimy or wet by a paper web as the web moves around the surface. For example, as an alternative to cleaning the vacuum-enhanced pick-up roll 22 of the FIG. 1 embodiment, a doctor system may be used to clean the surface of a transfer vacuum roll of the papermachine.

Figure 3:
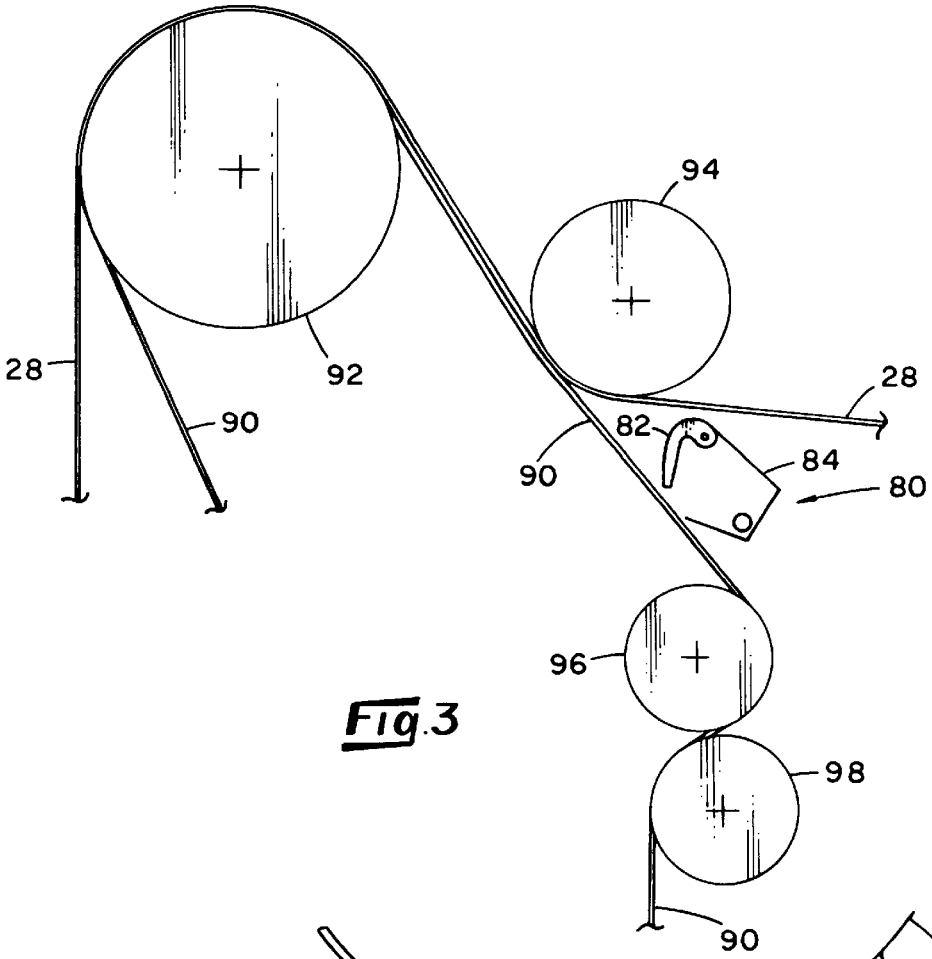
FIG. 3 is a schematic side view of a fragment of a press section of a papermachine within which an embodiment of a doctor system is utilized.

Further still, there is shown in FIG. 3 an embodiment, generally indicated 80, of an air doctor system utilized for cleaning the surface of a transfer belt 90 which is routed around a series of cylindrical rolls 92, 94, 96 and 98 located within the press section of a papermachine. In the depicted FIG. 3 environment, a running web 28 is moved in concert with the belt 90 as the belt 90 is routed around the rolls 92 and 94 but the web 28 and belt 90 separate from one another as they move off of the roll 94. Since the contaminant and water content of the paper web 28 may still be relatively high as it moves through the press section, grime and water are likely to be transferred from the web 28 to the surface of the transfer belt 90 as the belt 90 moves into (and subsequently out of) engagement with the web 28.

Accordingly, the doctor system 80, with its nozzle 82 and collection receptacle 84, are positioned along the belt 90 adjacent the off-running side of the roll 94 so that the nozzle 82 is mounted in a stationary condition within the press section and so that its discharge opening is directed angularly toward the surface of the belt 90. During operation of the air doctor system 80, air exits the nozzle 82 at a high velocity and cleans the surface of the belt 90 by separating grime and water from the belt surface.

Figure 4:
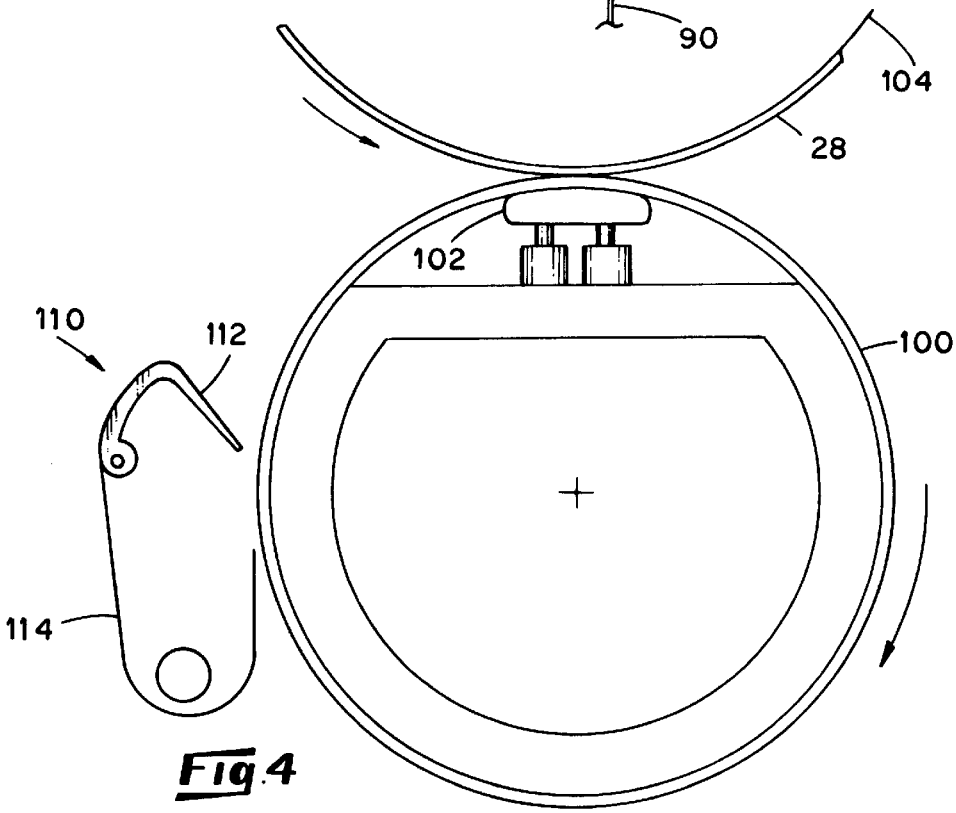
FIG. 4 is a schematic side view of another fragment of a press section of a papermachine within which an embodiment of a doctor system is utilized.

Similarly, there is shown in FIG. 4 a fragment of a press section of a papermachine wherein an endless synthetic belt 100 and a running web 28 are routed between the surfaces of a presser member 102 and the surface of a cylindrical roll 104. In operation, water is squeezed from the web 28 as the web 28 and belt 100 are moved between the surfaces of the member 102 and the roll 104, and consequently, the belt 100 is begrimed and wetted by its exposure to the web 28 at this stage of the papermaking process. To clean the surface of the belt 100 of grime and water droplets, an air doctor system 110, with its air nozzle 112 and collection receptacle 114, is positioned adjacent a location of the belt surface upstream of the location at which the belt 100 is returned into engagement with the web 28.

In this connection, the nozzle 112 is mounted adjacent the belt 90 so that air which exits the nozzle 112 flows angularly toward the surface of the belt 90. In this embodiment 110, the nozzle 112 is oriented so that the path of the air which exits the nozzle 112 has a component which corresponds the direction opposite the direction of movement of the belt 90 past the nozzle 112. Accordingly, the path of the air knife which exits the nozzle of an air doctor system in accordance with the broader aspects of the invention does not always have a component which corresponds to the direction of movement of the surface being cleaned by the air knife. In any event, the air knife which exits the nozzle 112 strikes the surface of the belt 90 and dislodges (and thereby separates) grime and water from the belt surface, and the dislodged grime and water are collected in the collection receptacle 114 for disposal.

Figure 5:
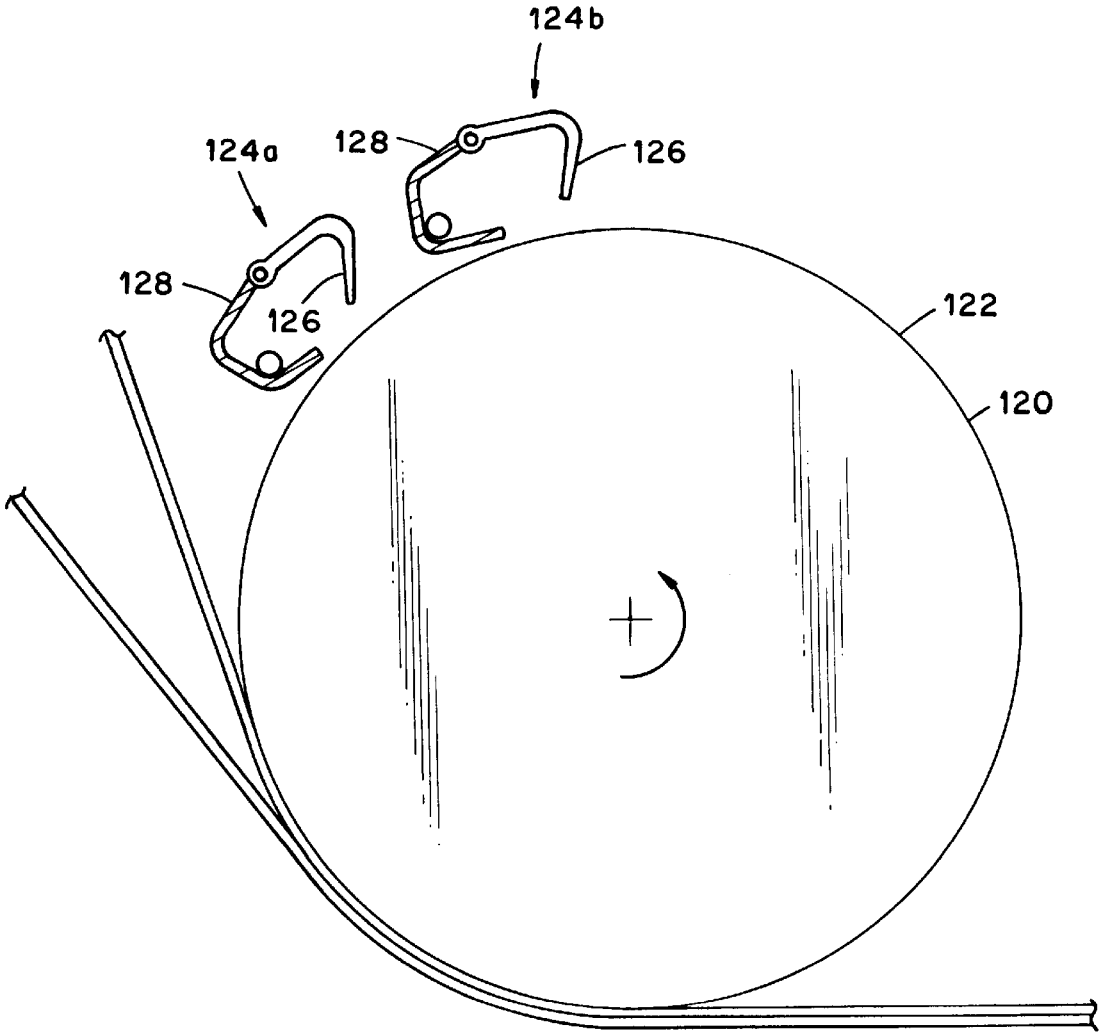
FIG. 5 is a view similar to that of FIG. 1 of a pick-up roll and a pair of doctor systems utilized with the roll.

It will be understood that numerous modifications and substitutions can be had to the aforedescribed embodiments without departing from the spirit of the invention. For example, although the aforedescribed air doctor systems have been shown and described as the singular means by which a component surface is cleaned, each air doctor system may be one of a number of air doctor systems used to clean the same surface. For example, there is shown in FIG. 5 a cylindrical pick-up roll 120 having a surface 122 along which two air doctor systems 124*a* and 124*b* are mounted so that each location along the surface 122 moves in sequence past the system 124*a* and then past the system 124*b*. Each system 124*a* or 124*b* has a nozzle 126 which is directed generally toward the roll surface 122 and a collection receptacle 128 disposed adjacent the surface 122 for collecting grime and water which are dislodged from the surface 122 by the corresponding nozzle 126. Such a plurality of air doctor systems may be desired in instances in which the component surface cannot be satisfactorily cleaned with a single pass of the surface in front of the doctor system nozzle.

Along the lines of the foregoing, a single doctor system may employ more than one nozzle so that during operation, a plurality of air knives are directed simultaneously toward the surface of a component to be cleaned. Accordingly, the aforedescribed embodiments are intended for the purpose of illustration and not as limitation.

I claim:

1. A doctor system for cleaning a papermachine component having a moving surface which is begrimed and wetted by a paper web moved around the moving surface, the system consisting essentially of:

nozzle means supportable adjacent the moving surface of a papermachine component which is begrimed and wetted by a paper web moved around the moving surface for directing air from a source in such a relation to the moving surface to separate grime and water from the moving surface and thereby clean the moving surface, the nozzle means having an opening through which air is directed out of the nozzle means from the source and the opening is in the form of a slot having two opposite edges between which air is directed out of the opening at a speed of no less than about 8,000 feet per minute so that the air which is directed from the source and out of the opening strikes the moving surface and acts as a knife which severs the grime and water from the moving surface; and receptacle means positionable adjacent the nozzle means for collecting grime and water which are separated from the moving surface by the directed air.

2. The system as defined in claim 1 wherein the nozzle means is supportable adjacent the moving surface of the papermachine component so that air which exits the opening of the nozzle means is directed at an angle with respect to the moving surface of the papermachine component to be cleaned by the system.

3. The system as defined in claim 2 wherein the slot has a width as measured between the opposite edges which is between about 1 mm and 3 mm and has a length which substantially corresponds with the length of the moving surface of the papermachine component to be cleaned by the system.

4. The system as defined in claim 1 wherein the receptacle means includes a trough for gravitationally collecting grime and water which are dislodged from the moving surface of the papermachine component by the directed air.

5. The system as defined in claim 1 wherein the nozzle means and the receptacle means are attached to one another to form a unitary assembly.

6. A doctor system for removing grime and water from the moving surface of a papermachine component which is begrimed and wetted by a paper web moved around the surface, the system consisting essentially of:

means for directing air for acting as a knife from a source substantially toward the moving surface of a papermachine component which is begrimed and wetted by a paper web moved around the moving surface, said air-directing means including at least one air nozzle positionable in a stationary condition adjacent the moving surface and having a discharge opening through which air is directed substantially toward the moving surface, and wherein the discharge opening is in the form of a slot having two opposite edges between which air is forced to exit the nozzle at a speed of no less than about 8,000 feet per minute so that when air is directed through the air nozzle toward the moving surface, the air acts as a knife which severs, and thereby dislodges, grime and water from the moving surface and are blown free of the moving surface by the air; and receptacle means positionable adjacent the moving surface of the papermachine component for collecting grime and water which are dislodged from the moving surface by the directed air.

7. The system as defined in claim 6 wherein the slot of the discharge opening has a width as measured between the opposite edges which is between about 1 and 3 mm and has a length which substantially corresponds with the length of the moving surface to be cleaned.

8. The system as defined in claim 6 wherein the receptacle means includes a trough for gravitationally collecting grime and water which are dislodged from the moving surface of the papermachine component by the directed air.

9. The system as defined in claim 6 wherein the nozzle means and the receptacle means are attached to one another to form a unitary assembly.

10. The system as defined in claim 6 further comprising means providing an access port upstream of the nozzle through which a cleaning substance can be introduced into the stream of air conducted toward the nozzle.

11. The system as defined in claim 6 further comprising vacuum means connected to the receptacle means for evacuating the grime and water from the receptacle means.

12. The system as defined in claim 6 wherein the air-directing means is adapted to direct air through the discharge opening of the nozzle at a speed of between about 8,000 and 40,000 feet per minute.

13. A method for cleaning the moving surface of a papermachine component which is begrimed and wetted by a paper web moved around the surface, the method consisting essentially of the steps of:

providing nozzle means through which air can be directed substantially toward the moving surface of a papermachine component which is begrimed and wetted by a paper web moved around the surface of the component and wherein the nozzle means includes a discharge opening in the form of a slot having opposite edges between which air is directed substantially toward the moving surface of the papermachine;

positioning the nozzle means in a stationary condition adjacent the moving surface of the papermachine component;

directing air through the discharge opening of the nozzle means in a high speed stream from a source substantially toward the moving surface of the component for acting as a knife so that air which exits the nozzle means flows between the opposite edges of the opening at a speed of no less than about 8,000 feet per minute to sever, and thereby dislodges grime and water from the moving surface of the papermachine component and thereby clean the moving surface of the papermachine component; and collecting grime and water which are dislodged from the moving surface of the papermachine component by the directed air.

14. The method as defined in claim 13 wherein the step of positioning the nozzle means includes the step of orienting the nozzle means so that the discharge opening thereof is directed angularly with respect to the surface of the component.

15. The method as defined in claim 13 wherein the step of directing air through the nozzle means effects a movement of the air through the discharge opening at a speed of between about 8,000 and 40,000 feet per minute.

* * * * *